US005678357A

United States Patent [19]

Rubio et al.

[11] Patent Number: 5,678,357

[45] Date of Patent: Oct. 21, 1997

[54] INTERACTIVE INFLATABLE TOY

[76] Inventors: Jesse Rubio, 606 Durian St., Vista, Calif. 92083; Guy W. Rochefort, 554 Stratford Dr., Encinitas, Calif. 92024

[21] Appl. No.: 619,067

[22] Filed: Mar. 20, 1996

[51] Int. Cl.[6] ..... E04B 1/34

[52] U.S. Cl. ..... 52/2.17; 52/2.22; 40/212; 446/220; 472/134

[58] Field of Search ..... 51/2.11, 2.13, 51/2.14, 2.17, 2.22; 472/134, 135; 40/736, 212; 482/35, 36; 446/220, 222, 223, 226

[56] References Cited

U.S. PATENT DOCUMENTS 4,103,369 8/1978 Riordan ..... 51/2.14
5,125,177 6/1992 Colting ..... 446/226 X
5,471,797 12/1995 Murphy ..... 472/134 X
5,592,960 1/1997 Williams ..... 135/901 X

*Primary Examiner*—Wynn Y. Wood
*Assistant Examiner*—Aimee E. McTigue
*Attorney, Agent, or Firm*—William Patrick Waters

[57] ABSTRACT

An apparatus and method of attaching reversibly an inflatable three dimensional graphic to the exterior surface of an inflatable wall of an inflatable toy. The wall surface includes means for reversibly attaching the graphic in a leak tight manner while providing a method for fluid communication between the wall and the graphic so that the graphic can be inflated simultaneously with the wall.

5 Claims, 1 Drawing Sheet

INTERACTIVE INFLATABLE TOY

FIELD OF THE INVENTION

The present invention relates generally to toys and, more particularly, to interactive inflatable toys having wait spaces containing air under pressure.

BACKGROUND ART

Interactive inflatable toys are growing in popularity among children and the toys can represent an important source of revenue for enterprises, such as amusement parks and malls where children gather. In some cases, a typical interactive inflatable toy includes a large, box shaped structure comprised of air retaining, impervious plastic walls. Generally, the walls are comprised of plastic sheets stitched together to form air retaining spaces. A conventional electrical air blower is utilized to inflate the wall spaces thereby keeping the walls in an overpressure condition during use.

The inflatable toys to which the present invention relates generally have an opening in the front end, covered by a flap or panel, through which children can enter to play within the device. In some cases, a trampoline, which can be used simultaneously by several children, is located inside the inflatable toy.

For examples of interactive inflatable toys, reference may be made to U.S. Pat. Nos. 3,676,276; 5,299,989; 5,385,518 and 5,462,505. While the inventions disclosed in these patents comprise various types of inflatable toy, none of them teach a toy which a child can enter for play and exercise on the inside. Such a toy is disclosed in U.S. Pat. No. 5,471,797 in which an inflatable enclosure a child may enter for amusement purposes and for promoting physical activity is described.

It is generally desirable, in order to provide a toy which is attractive to customers, to make the inflatable toy bright and colorful. Thus, for example, the inflatable enclosure disclosed in U.S. Pat. No. 5,471,797 may be of various colors, even colors appropriate for a special season or event such as orange for the fall season or red and green for the Christmas season. It will be recognized that seasonal colors, although making the toy more attractive at a particular time of year, may well diminish the value of the toy at other times of the year.

In addition to the use of colors, it has been found that inflatable toys can be made more attractive to children if the toy displays attractive themes or personalities. In this regard, the inflatable enclosure of the aforementioned U.S. Pat. No. 5,471,797, in a preferred embodiment, has on its front wall a happy face design formed of two eyebrows, a nose and a smiling mouth. In addition, the inflatable enclosure can also have attachments or projections such as ears, fins, noses and stems resembling pumpkins to enhance the attractiveness of the toy to children. In these cases, however, as in the instances where seasonally limited colors can diminish the value of the toy in the off season, attachments or projections to the inflatable toy sometimes limit or diminish the value of the toy as popular tastes change.

Recognizing that their value can be affected by changing seasons and customs, owners of inflatable toys sometimes decorate the exterior walls of a toy with pictures of soccer balls, baseballs, sports figures or cartoon characters which can be readily changed as popular tastes change. Thus, for example, when the baseball season gives way to football, the images adorning the walls of the inflatable toy can be conveniently and inexpensively changed.

While changing depictions on the walls of the inflatable toys has some utility, it is often less than desirable since no substantive change is made to the inflatable toy itself to make it conform to changing popular tastes. In recognition of this consideration, manufacturers of interactive inflatable toys have begun producing such toys having "graphics". These graphics are often comprised of inflatable three dimensional representations of such things as soccer balls, footballs, or cartoon characters. Generally the graphics are constructed plastic material similar to that of the wall of the toy and are integrally attached to the top wall of the inflatable toy to become inflated when the toy itself is inflated.

Even while recognizing the value of inflatable graphics in presenting popular themes to customers, they have limitations since they are not adaptable to changing popular tastes. In this regard, an interactive inflatable toy having an outdated graphic adds very little to the popularity of the toy and, in fact, can rapidly diminish the value of the toy itself. This is an important consideration in light of the fact that modern interactive inflatable toys can cost several thousand dollars.

In view of the foregoing, it would be highly desirable to have an apparatus, and a method, for enabling the owner of an interactive inflatable toy to modify the toy conveniently to conform to changing popular tastes. Ideally, such an invention would enable the toy owner conveniently to make changes to the toy according to changing sports seasons and popular tastes, thus giving the toy in an up to date appearance. Advantageously, such an apparatus and method would be inexpensive, efficient and readily implemented by the toy owner on site and without the need of returning the toy to its manufacturer.

DISCLOSURE OF INVENTION

It is an object of the present invention to provide an apparatus and method for altering the appearance of an inflatable toy.

It is another object of the present invention to provide such an apparatus and method which is inexpensive and convenient to install.

It is a further object of the present invention to provide such an apparatus and method which could be utilized on site while minimizing downtime for the inflatable toy.

Briefly, the above and further objects of the present invention are realized by providing an apparatus and method of attaching reversibly an inflatable three dimensional graphic to the exterior surface of an inflatable wall of an inflatable toy. The wall surface includes means for reversibly attaching the graphic in a leak tight manner while providing a method for fluid communication between the wall and the graphic so that the graphic can be inflated simultaneously with the wall.

The present invention provides several advantages. In the first place, it enables the owner of an interactive inflatable toy to change graphics in a convenient manner to adapt to changing popular tastes. The changes can be readily accomplished on site, without any necessity of returning the toy to its manufacturer for modification. In addition, the present invention provides adaptability for the toy owner at a low cost.

BRIEF DESCRIPTION OF DRAWINGS

The above mentioned and other objects and features of this invention and the manner of attaining them will become apparent and the invention itself will be best understood by reference to the following description of the embodiment of the invention in conjunction with the accompanying drawings, wherein.

BEST MODE FOR CARRYING OUT THE INVENTION

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

It should be noted that the term "leak tight" is meant to be interpreted in a relative, not an absolute sense. One skilled in the art of inflatable toys will readily understand that air leakage from such toys, through the sewn seams for example, is a regular and ongoing phenomenon. The leakage, of course, is more than balanced by a blower which keeps the toy in an inflated condition. In addition, the term "graphic" is intended to mean the inflatable three dimensional figures conventionally seen on interactive inflatable toys.

Figure 1:
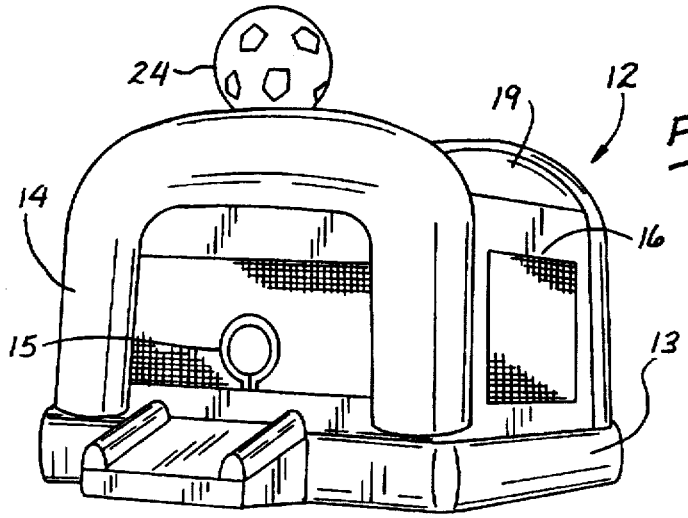
FIG. 1 is a perspective view of an interactive inflatable toy showing an inflatable graphic in the form of a representation of a soccer ball attached to its top wall.

Referring now to the drawings, and more particularly to FIG. 1, there is shown a conventional interactive inflatable toy 12. The toy 12 includes inflatable walls such as a bottom wall 13, a front wall 14, a side wall 16, and a top wall 19. An opening 15 in the front wall 14 permits children to enter and exit the toy 12. In operation, a conventional electrical blower (not shown) is used to inflate the walls, including the walls 14, 16 and 19, to maintain the toy 12 in an upright, slightly pressurized condition. An inflatable graphic 24, in the form of a representation of a soccer ball, is shown attached to the top wall 19 of the toy 12. The graphic 24 is in fluid communication with the interior of the top wall 19 so that air under pressure flows readily from the top wall 19 into the graphic 24 to maintain the graphic in an overpressure condition.

Figure 1A:
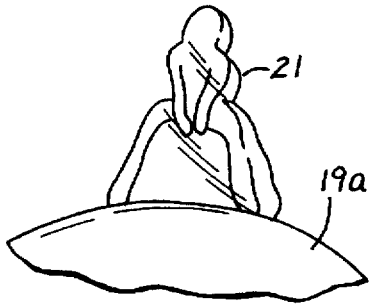
FIG. 1*a* is a fragmentary view showing a portion of the interactive inflatable toy of FIG. 1 having an inflatable graphic in the from of a cartoon character affixed thereto.

In a conventional interactive inflatable toy, the inflatable graphic, such as the graphic 24, is permanently fixed to the top wall of the toy. As a result, when the soccer season comes to an end, the inflatable toy loses popularity and its owner is hurt financially. Sometimes, because of a popular movie, for example, it becomes desirable to have a inflatable toy having a popular cartoon character, such as the character 21 depicted generally in FIG. 1*a* attached to a top wall 19*a* of a conventional toy. Conventionally, to meet the demand for the new character, a new inflatable must be constructed, at substantial cost, to replace the toy with the soccer ball. This process, of course, is expensive and inefficient. The present invention eliminates this process by providing the inflatable toy owner with a novel technique for conveniently replacing the inflatable graphic to keep the toy in a popular condition.

Figure 2:
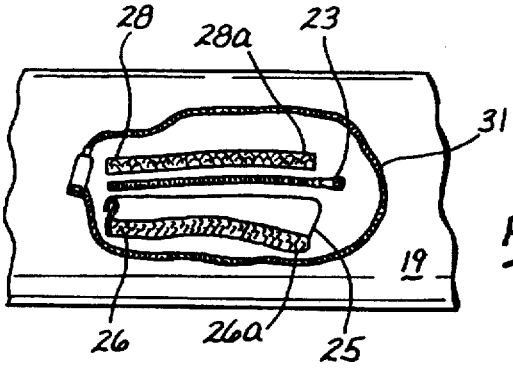
FIG. 2 is a fragmentary view of a portion of the top wall of the interactive inflatable toy of FIG. 1.

With reference now to FIG. 2, there is shown a view of a portion of the top wall 19 of FIG. 1. This portion is located in an area on the top wall where the inflatable graphic 24 is fixed. An airtight zipper 23, shown in the figure in a closed condition, is located on the top wall 19. The zipper 23 is used in a closed condition when the toy 12 is inflated and an inflatable graphic is not attached. In this case, a flexible flap 25 is used to relieve lateral tension on the zipper 23 thereby helping to maintain an air tight condition in the toy 12. The flap 25 is composed of flexible cloth like material. It is fixed at its proximal end to the exterior surface of the top wall 19 and it includes bands 26 and 26*a*, each composed of Velcro™ material. The bands 26 and 26*a* engage reversibly complementary Velcro™ bands 28 and 28*a* which are fixed to the exterior of the top wall 19 on the side opposite the zipper 23.

Figure 3:
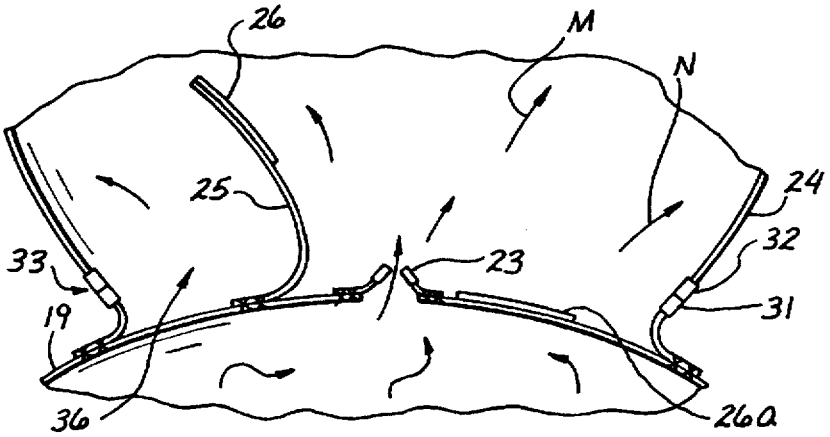
FIG. 3 is a fragmentary side view of a portion of the top wall and a portion of the inflatable graphic of FIG. 1.

Referring now to FIGS. 2 and 3, circumscribing the zipper 23 and the flap 25, is a first half 31 of a zipper 33. The first zipper half 31 is sealingly fixed to the exterior surface of the top wall 19. A corresponding zipper half 32 is fixed circumferentially along an opening 36 in the inflatable graphic 24.

In order to attach the inflatable graphic 24, with reference to FIGS. 2 and 3, with the toy 12 in a deflated condition, the flap 25 is raised from its sealing position and the zipper 23 is opened to permit fluid communication between the toy 12 and the graphic 24. The first zipper half 31 and the second zipper half 32 are joined in a conventional manner to provide a leak tight seal to prevent air from leaking at the junction of the inflatable graphic 24, and the top wall 19.

With the inflatable graphic in place, the above mentioned blower (not shown) can be activated to inflate the toy 12. As the toy 12 is inflated, air flows from the toy along the flow path suggested by the arrows M and N (FIG. 3) to inflate the graphic 24.

It will be readily appreciated that the graphic 24 can be conveniently replaced by another selected graphic simply by deflating the toy 12 and opening the zipper 33. With the graphic 24 thus removed, another graphic, such as the graphic 21 of FIG. 2, having attachment means (not shown) similar to that of the graphic 24, can be conveniently installed.

It will be evident that there are additional embodiments and applications which are not disclosed in the detailed description but which clearly fall within the scope and spirit of the present invention. The specification is, therefore, intended not to be limiting, and the scope of the invention is to be limited only by the following claims.

What is claimed is:

1. An inflatable toy having a plurality of inflatable walls, said walls defining an interior space within said toy, each one of said plurality of walls having an interior surface and an exterior surface, said toy being adapted for a first use wherein said toy is inflated and an inflatable graphic is attached thereto, and for a second use wherein said toy is inflated and no graphic is attached thereto, said toy comprising:

attachment means fixed to the exterior surface of one of said plurality of walls for attaching an inflatable graphic thereto;

means for providing fluid communication between said toy and an attached inflatable graphic when said toy is used in a first use and for fluid sealing said exterior surface when said toy is used in a second use, and means forming an opening in said toy for permitting access to the interior space of said toy when the walls thereof are inflated.

2. The inflatable toy according to claim 1, wherein said means for providing fluid communication in a first use and for fluid sealing in a second use is a zipper.

3. The inflatable toy according to claim 1, wherein said attachment means fixed to said exterior surface, includes one half of a zipper.

4. The inflatable toy according to claim 3, wherein said one half of said zipper is ovoid in shape and said one-half of said zipper surrounds said means for providing fluid communication between said toy and an attached inflatable graphic when said toy is used in a first use and for fluid sealing said exterior surface when said toy is used in a second use.

5. The inflatable toy according to claim 3, wherein said one half of said zipper is circular in shape and said one half of said zipper surrounds said means for providing fluid communication between said toy and an attached inflatable graphic when said toy is used in a first use and for fluid sealing said exterior surface when said toy is used in a second use.

* * * * *